US007221274B2

(12) United States Patent
Fawcett et al.

(10) Patent No.: US 7,221,274 B2
(45) Date of Patent: May 22, 2007

(54) DOCKING STATION FOR SECURITY KEY

(75) Inventors: Christopher J. Fawcett, Charlotte, NC (US); Ronald M. Marsilio, Lake Wiley, SC (US)

(73) Assignee: Alpha Security Products, Inc., Charlotte, NC (US)

( * ) Notice: Subject to any disclaimer, the term of this patent is extended or adjusted under 35 U.S.C. 154(b) by 324 days.

(21) Appl. No.: 11/026,584

(22) Filed: Dec. 30, 2004

(65) Prior Publication Data

US 2006/0145849 A1 Jul. 6, 2006

(51) Int. Cl.
*G08B 13/14* (2006.01)

(52) U.S. Cl. ..... 340/568.2; 340/693.9; 70/14; 70/57.1; 70/58

(58) Field of Classification Search ..... None
See application file for complete search history.

(56) References Cited

U.S. PATENT DOCUMENTS 3,972,039 A * 7/1976 Marshall ..... 340/508
4,112,717 A * 9/1978 Bradley ..... 70/63
4,284,983 A * 8/1981 Lent ..... 340/522
4,549,170 A * 10/1985 Serres et al. ..... 340/568.1
4,567,741 A * 2/1986 Trempala ..... 70/389
4,595,922 A * 6/1986 Cobb et al. ..... 340/825.49
4,635,053 A * 1/1987 Banks et al. ..... 340/5.32
4,661,806 A * 4/1987 Peters et al. ..... 340/568.1
4,663,611 A * 5/1987 Humphrey ..... 340/542
4,673,915 A * 6/1987 Cobb ..... 340/330
5,038,023 A * 8/1991 Saliga ..... 235/385
5,172,829 A * 12/1992 Dellicker, Jr. ..... 221/13
5,280,518 A * 1/1994 Danler et al. ..... 379/102.06
5,389,916 A * 2/1995 Chen et al. ..... 340/650
5,423,198 A * 6/1995 DiVito et al. ..... 70/278.3
5,533,079 A * 7/1996 Colburn et al. ..... 377/6
5,612,683 A * 3/1997 Trempala et al. ..... 340/5.23
5,801,628 A * 9/1998 Maloney ..... 340/568.2
5,836,002 A * 11/1998 Morstein et al. ..... 340/568.1
5,960,651 A * 10/1999 Tanisawa ..... 70/14
6,075,441 A * 6/2000 Maloney ..... 340/568.1
6,195,005 B1 * 2/2001 Maloney ..... 340/568.1
6,204,764 B1 * 3/2001 Maloney ..... 340/568.1
6,232,876 B1 * 5/2001 Maloney ..... 340/568.1
6,262,664 B1 * 7/2001 Maloney ..... 340/572.8
6,389,853 B1 * 5/2002 Pate et al. ..... 70/18
6,431,438 B1 * 8/2002 Pires et al. ..... 235/375
7,068,162 B2 * 6/2006 Maple et al. ..... 340/539.11
7,102,515 B2 * 9/2006 Kreft et al. ..... 340/568.2
7,109,864 B2 * 9/2006 Maloney ..... 340/568.1
2006/0170549 A1 * 8/2006 Belden et al. ..... 340/568.2

* cited by examiner

*Primary Examiner*—Benjamin C. Lee
(74) *Attorney, Agent, or Firm*—Sand & Sebolt

(57) ABSTRACT

A docking station has a housing with an open top compartment formed therein for storing a security key in a locked condition when not in use at a checkout station for opening media security containers. A slide member is moveable by a three position key operated tumbler between locked and unlocked positions across the storage compartment opening. A cam is slidably engageable with the slide member and is moveable by the tumbler for moving the slide member between the locked and unlocked positions. An alarm deactivation switch is actuated by the cam when the tumbler is rotated by the tumbler key to a third position past the locked position. The alarm communicates with a sense loop extending through a flexible expandable cord attaching the key to the housing. An LED provides a visual indication that the alarm is activated.

20 Claims, 9 Drawing Sheets

DOCKING STATION FOR SECURITY KEY

BACKGROUND OF THE INVENTION

1. Technical Field

The invention relates to a device for temporarily storing a security key in a locked condition at a checkout counter of a retail establishment when not in use for opening security protected packages. More particularly, the invention relates to such a storage device which has a key actuated tumbler for locking a security key which is attached to the device in a storage compartment when not in use and under proper supervision.

2. Background Information

Due to the increase in shoplifting, because of the manner in which articles of merchandise are displayed in large retail establishments, various types of packages have been devised in which the articles of merchandise are stored, yet displayed in the retail establishment to reduce shoplifting. Most of these security packages contain an EAS tag or other type of theft deterrent device which must be removed or deactivated at the checkout counter to prevent a shoplifter from leaving the store without first paying for the item of merchandise. These security tags actuate an alarm usually located at the exit of the store, if not removed or deactivated at the checkout counter.

Many of these security packages require a specific type of key, either a specially designed mechanical key which moves various locking tabs within the package, or magnetic keys which move magnetically attractable locking members in the security package, enabling the item of merchandise to be removed from the package and given to a customer after purchase.

It has been found that the security key also is susceptible to theft either by an unauthorized employee or even a customer, and then used either at that retail establishment or at another retail store at a later time to open and/or deactivate certain security packages, enabling the items of merchandise to be stolen from the retail establishment. Thus, many of these security keys are tethered by a cable or other type of coiled cord at the checkout station to reduce theft of the key. Although this has proved successful to some extent, it is desirable that even a greater theft deterrent be provided for the security key, especially when the checkout clerk, and/or the supervisor is not at or adjacent the checkout station.

Therefore, the need exists for a device for storing the security key in a secured locked position when not in active use or when left in an unsupervised manner at the checkout station.

BRIEF SUMMARY OF THE INVENTION

Objectives of the invention include providing a docking station for temporarily housing a security key in a secure locked position such as at the checkout station of a retail establishment to protect the key from theft when not being actively used and when left in an unsupervised manner.

A further aspect of the invention is to provide a docking station for a security key in which the key is attached to the docking station by a cord or other type of tether when being actively used and which then can be placed and locked in a storage chamber formed in the docking station by a removable key when left unattended.

Another aspect of the invention is to provide such a docking station in which a key-operated tumbler moves a cam into engagement with a slidable plate, which is moveable across an opening of the key storage compartment to prevent removal of the key from the compartment when placed therein.

Still another feature of the invention is to provide the docking station with a three position key actuated tumbler moveable between first and second positions to move the slidable locking plate between open and closed positions, and a third position to deactivate an audible alarm.

A further aspect of the invention is to provide an alarm system in the docking station which is activated regardless of the position of the security key with respect to the docking station, and which will sound an audible alarm if a sense loop which extends through the cord which attaches the key to the docking station is interrupted, such as when the loop is cut, broken, or forcibly removed from the key or docking station.

A still further aspect of the invention is to provide the docking station with a visual indicating light, such a blinking LED, which advises the store personnel and potential shoplifter that the alarm system is activated.

Another aspect of the invention is to provide a docking station which can be securely attached to a supporting structure at the checkout station by a plurality of fasteners to prevent its unauthorized removal, and in which an outer housing of the docking station can be formed of inexpensive, yet sturdy durable plastic which will protect the alarm system and key-actuated tumbler within the interior thereof, preventing unauthorized access thereto.

These features are obtained by the docking station of the present invention, which is used for storing a security key in a secured condition, the general nature of which may be stated as including a housing formed with a compartment for storing the security key therein, wherein the compartment has an opening for placement and removal of the key into and from the compartment; a slide member selectively movable across at least a portion of the compartment opening between locked and unlocked positions to prevent removal of the key from the compartment when in the locked position; a key actuated cam operatively engageable with the slide member for moving the slide member between locked and unlocked positions; a cord connected to and extending between the housing and the security key to secure the key to the housing, wherein the cord contains electrical conductors forming an alarm sensing loop; and an alarm system contained within the housing and operatively connected to the cord for monitoring the integrity of the sensing loop and actuating an audible alarm if the integrity of the sensing loop is compromised.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numerals refer to similar parts of the drawings.

DETAILED DESCRIPTION OF THE INVENTION

Figure 1:
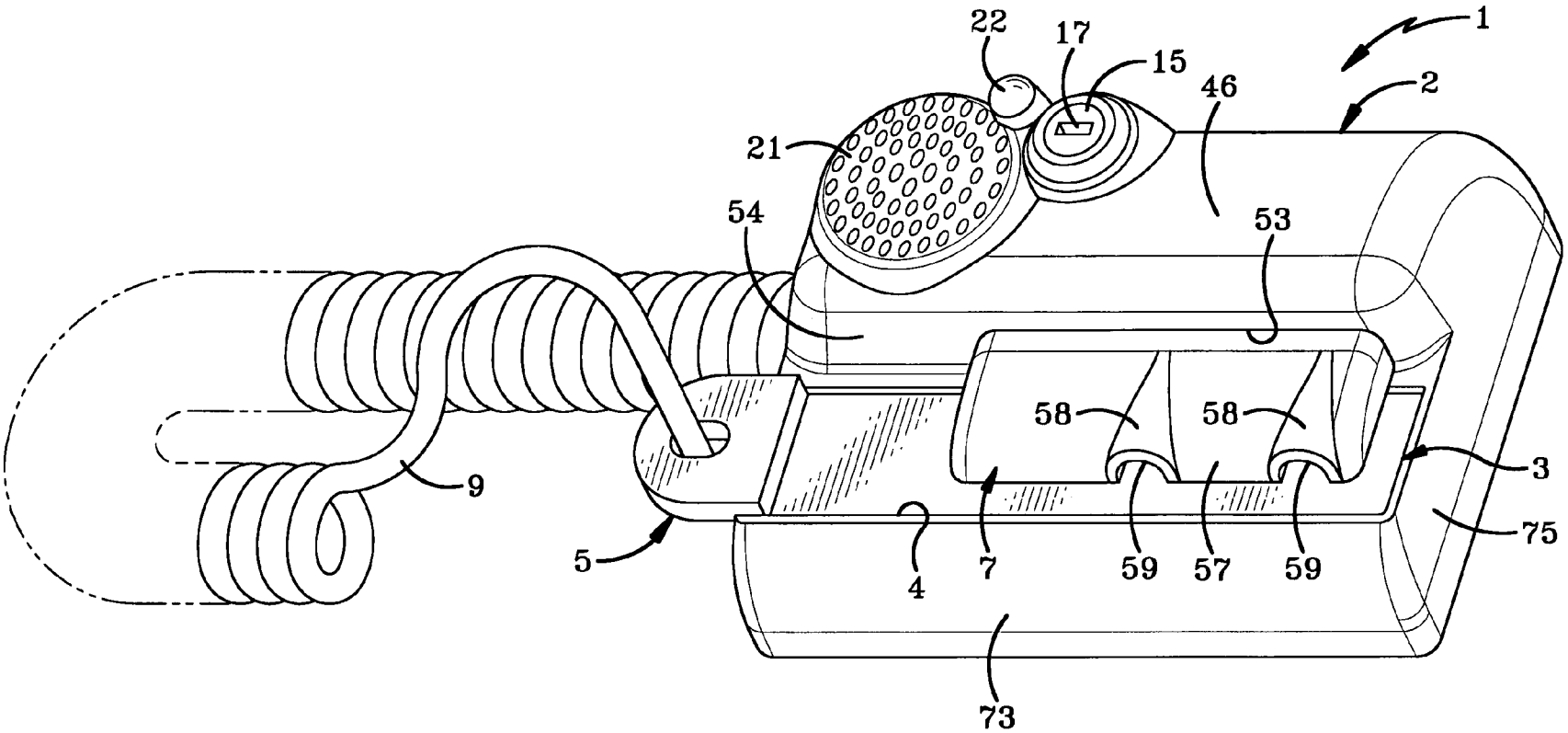
FIG. 1 is a top perspective view of the docking station with a security key in locked position.
Figure 2:
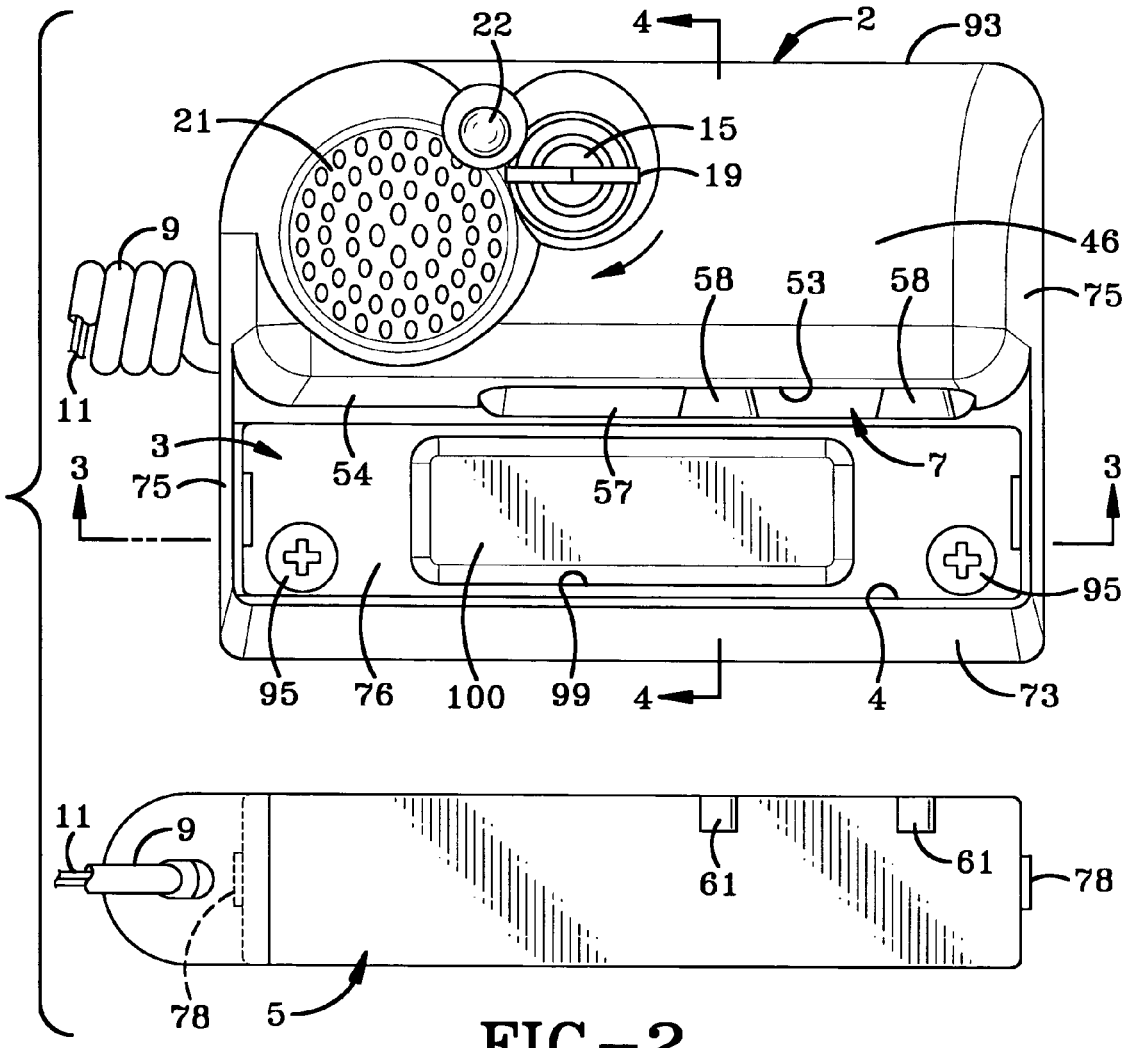
FIG. 2 is a top plan view of FIG. 1 with the key removed from the storage compartment of the docking station.
Figure 6:
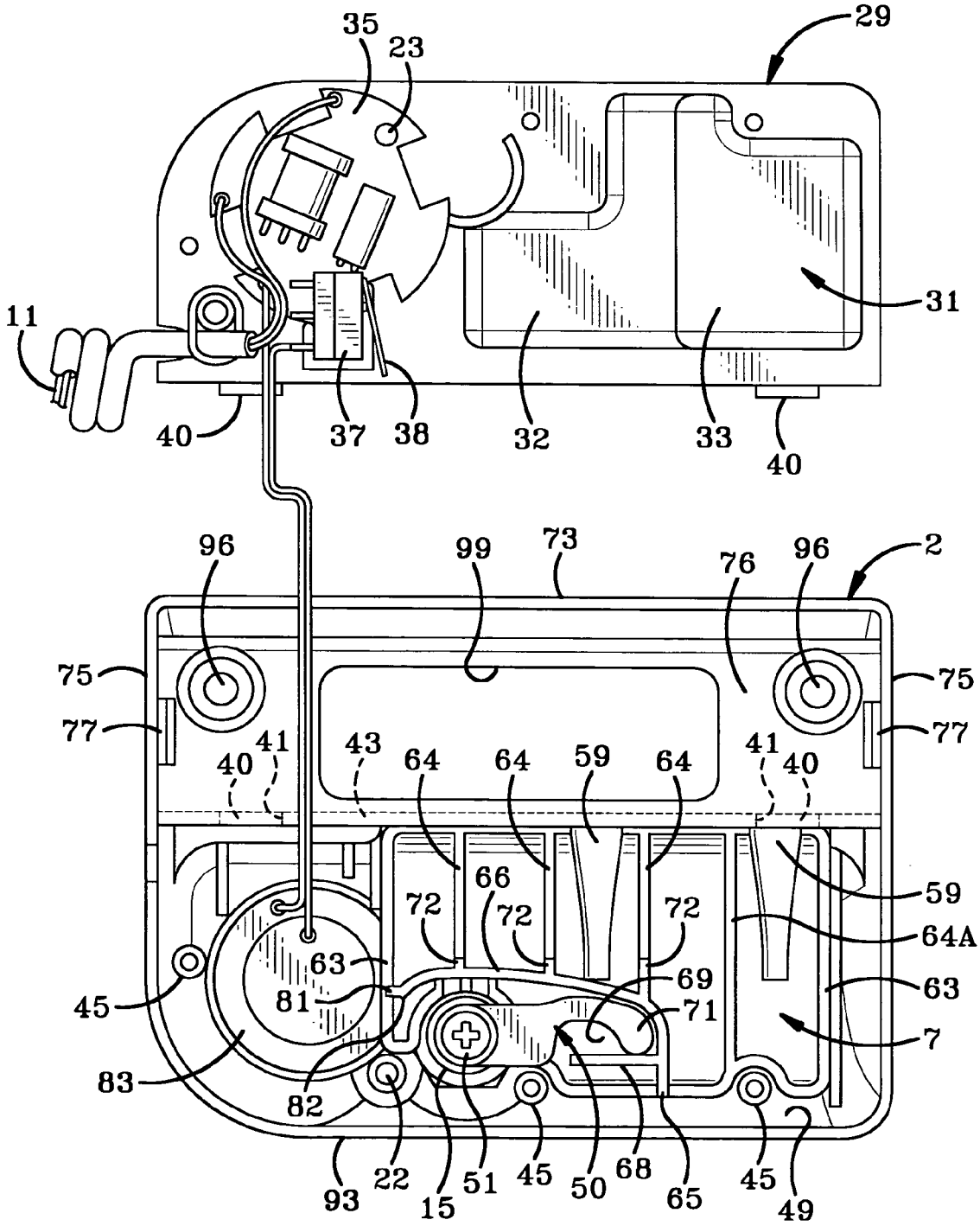
FIG. 6 is an exploded plan view of the bottom of the outer housing with the alarm support plate and alarm system being shown removed therefrom.

The docking station of the present invention is indicated generally at 1, and is shown in assembled operating condition in FIG. 1. Station 1 includes a housing member indicated generally at 2, preferably molded of plastic and formed with a front compartment 3 in which a security key 5 is shown locked therein by a locking slide plate 7. Key 5 is physically secured to housing 2 by a coiled cord 9, which preferably has a number of convolutions and is formed of a resilient material to enable the cord to be pulled outwardly from the housing after key 5 has been released therefrom for use in actuating a security package lock to remove the contents thereof usually at a checkout station. Cord 9 is similar to many cords used on telephones and has a pair of internal conductors 11 as shown in FIGS. 2 and 6, which form a sense loop for actuating an alarm system as discussed further below.

Figure 3:
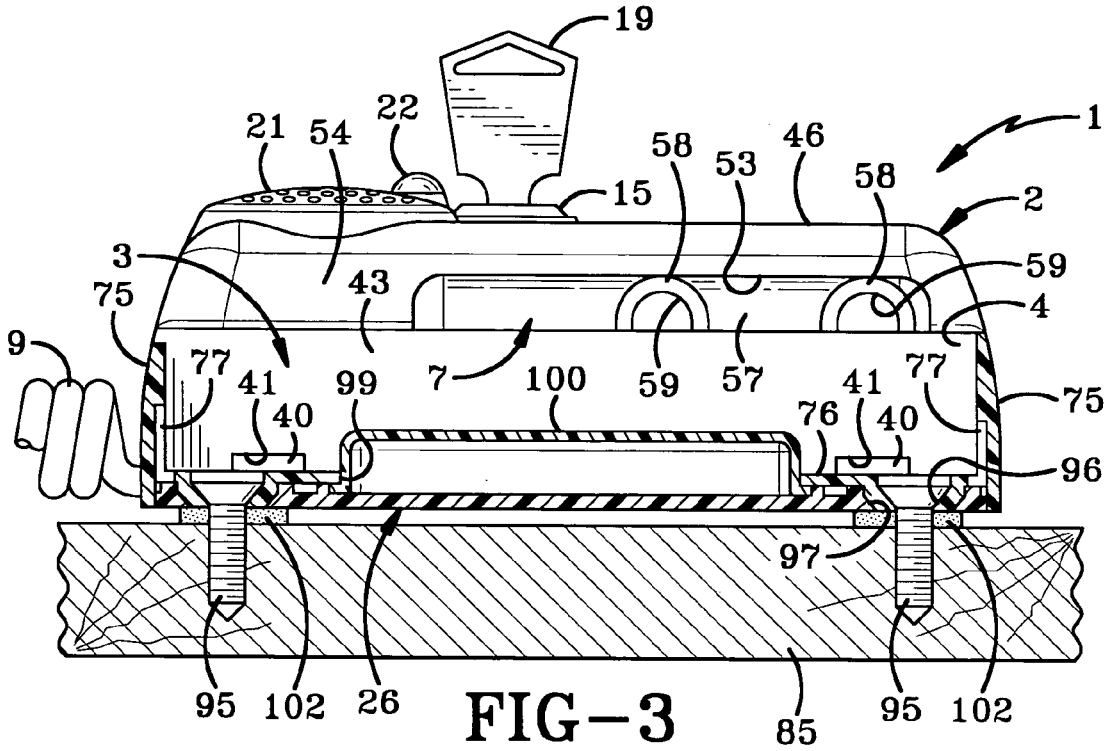
FIG. 3 is a sectional view taken on line 3—3, FIG. 2.

A three position key-actuated tumbler mechanism 15 is mounted in housing 2 and has its key slot 17 externally exposed for receiving a usual manually actuated key 19 therein (FIG. 3). A perforated grill 21 is formed on housing 2 behind which is an audible alarm. A lens 22 for a visual indicating LED 23 is located adjacent key tumbler mechanism 15 and grill 21 to provide a visual indication that the internal alarm system is activated as discussed below. The locking slide plate 7 is shown in a closed locked position in FIG. 1 extending over a top opening 4 of compartment 3 to prevent the removal of key 5 therefrom.

Figure 5:
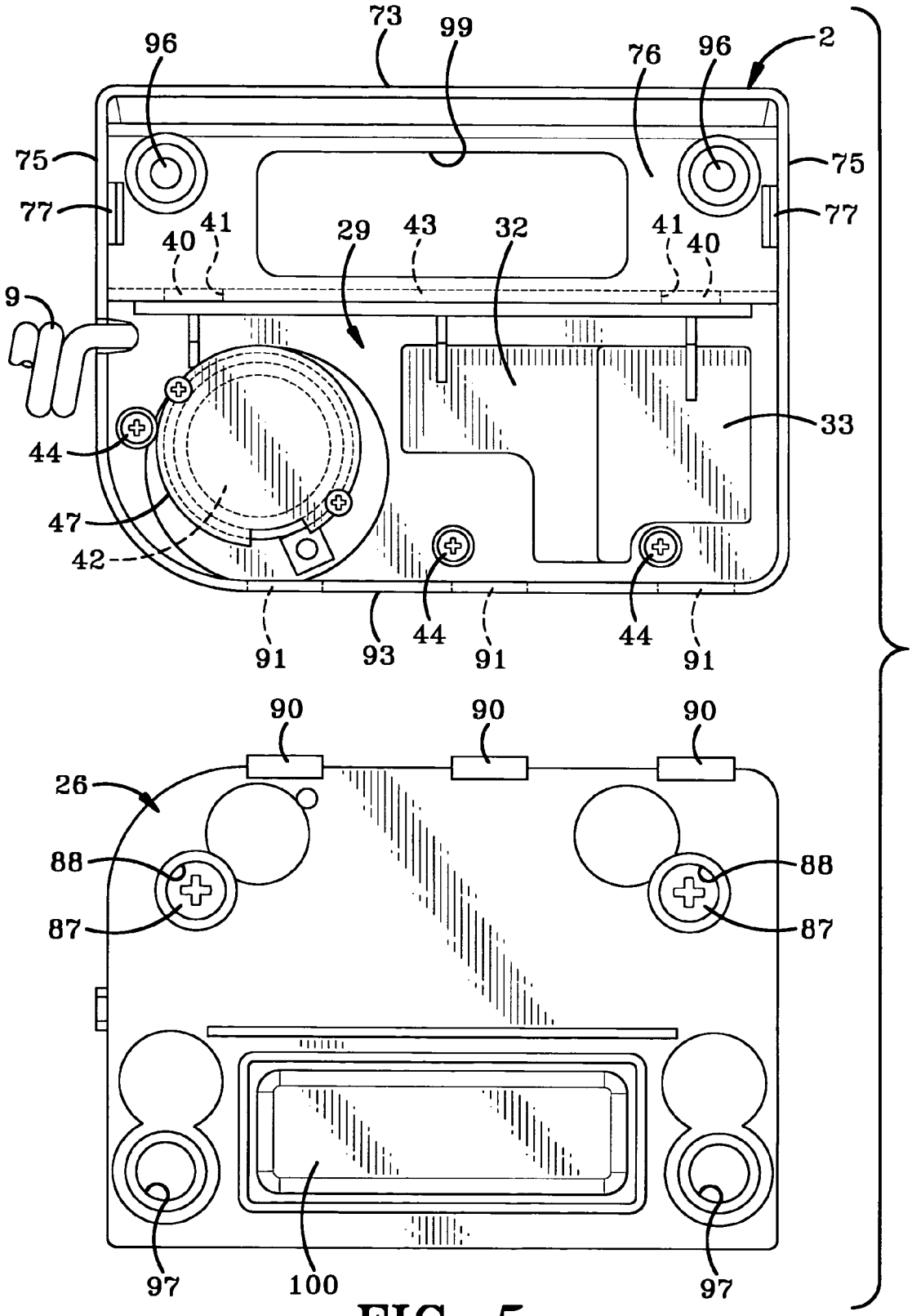
FIG. 5 is an exploded plan view of the bottom of the outer housing of the docking station with the bottom cover plate being removed therefrom.
Figure 8:
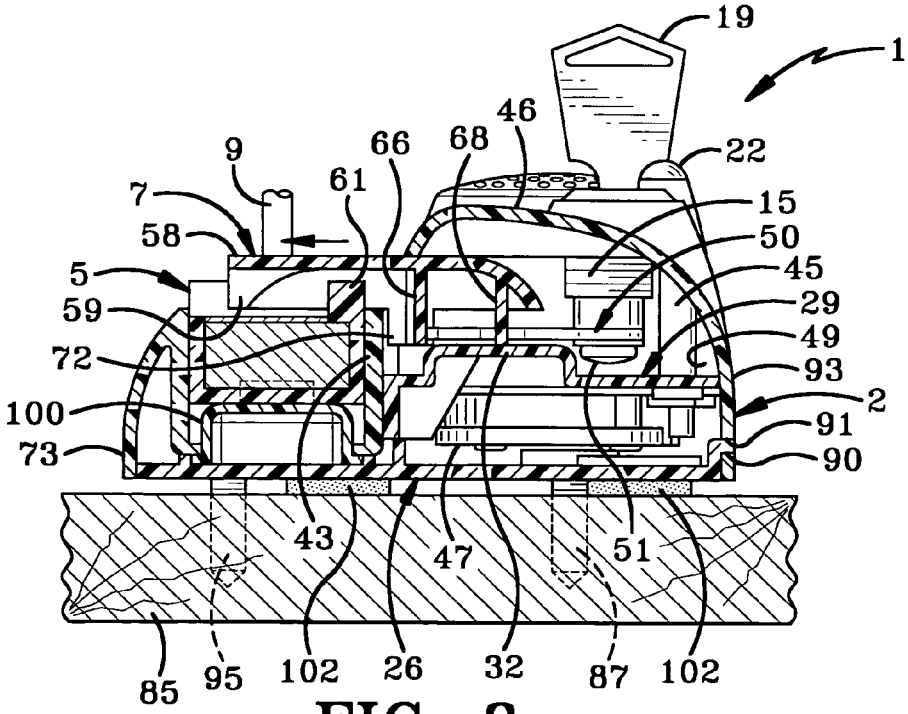
FIG. 8 is a sectional view taken on Line 8—8, FIG. 7.
Figure 10:
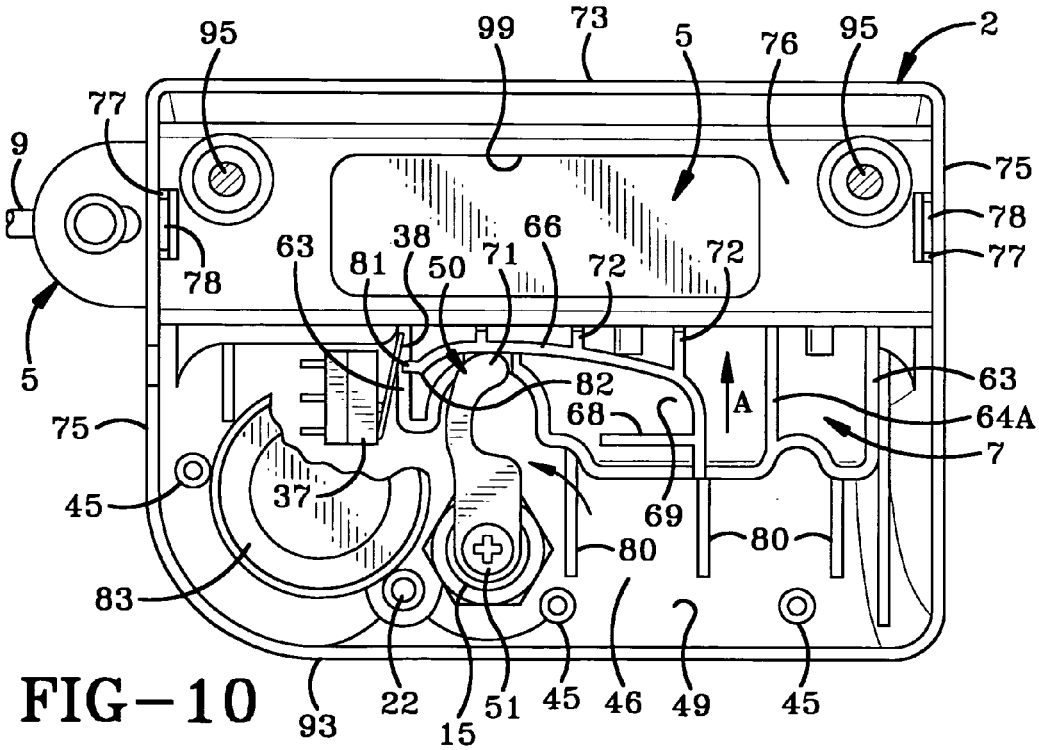
FIG. 10 is a view similar to FIG. 9 showing the position of the camming lever when the slide lock plate is moved to the locked position.
Figure 11:
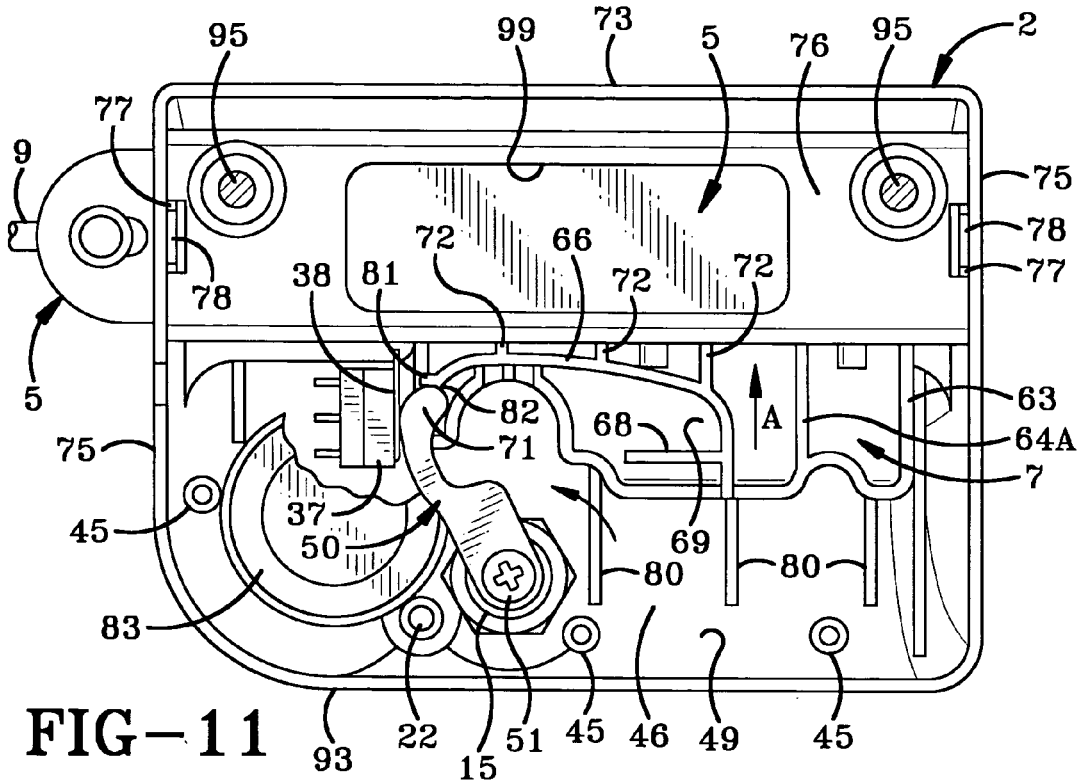
FIG. 11 is a view similar to FIGS. 9 and 10 showing the camming lever moved to a position to deactivate the audible alarm.

Housing 2 includes an upper housing portion 25 having an open bottom which is closed by a bottom wall plate 26. Upper housing 25 has a hollow interior in which is mounted the various components of the docking station, including an alarm system mounting plate 29 (FIG. 6). Mounting plate 29 is formed with a two-tiered platform indicated generally at 31, having a lower portion 32 and a raised portion 33. A printed circuit board 35 is mounted on plate 29 and includes the required capacitors and transistors to form an audible alarm system which is connected to conductors 11 of cord 9. LED 23 is mounted on circuit board 35 and provides a blinking light through lens 22 when the alarm system is activated. A switch 37 is mounted on plate 29 and operatively connected to printed circuit board 35. Switch 37 is a normally closed switch and is opened by an actuating lever 38 as discussed below, to deactivate the audible alarm as shown in FIG. 11. The circuit board and alarm system is connected to a battery 42 mounted in a recess beneath the circuit board and protected by a cover 47 (FIG. 5). Mounting plate 29 is secured within the hollow interior of upper housing 25 by a pair of tabs 40, which extend through openings 41 formed in a rear wall 43 of key storage compartment 3 (FIGS. 6 and 8). Plate 29 also is attached by three screws 44 (FIG. 5), which extend into aligned upstanding bosses 45 (FIG. 10) formed on and extending outwardly from top wall 46 of upper housing portion 25.

Figure 12:
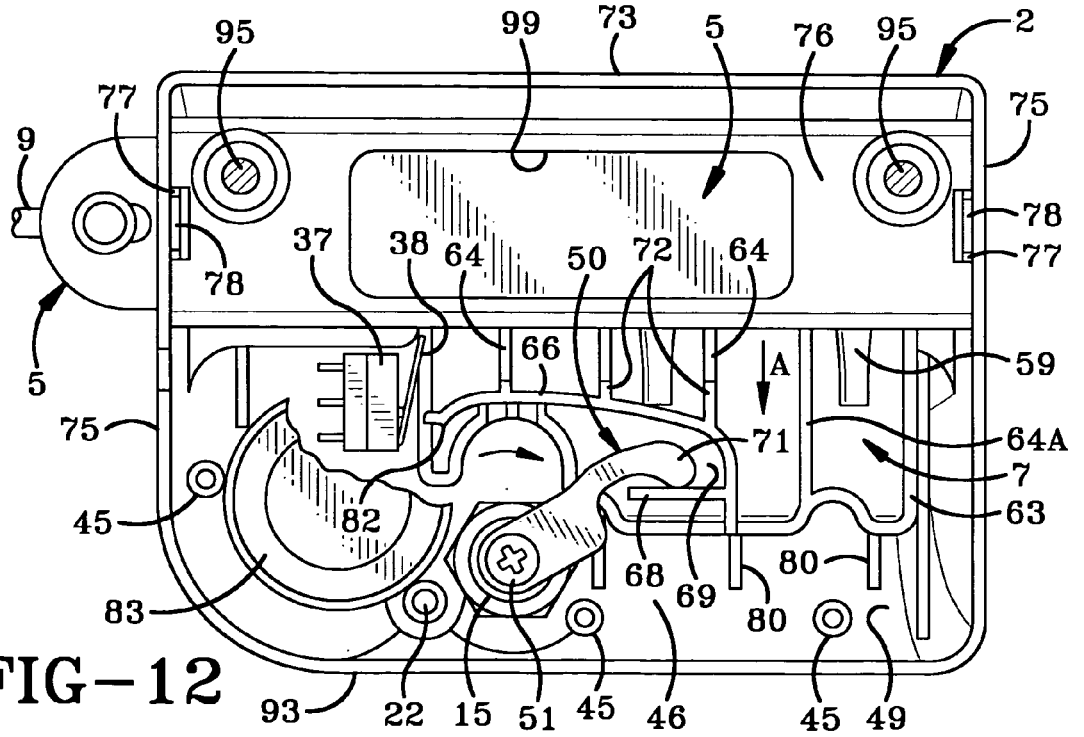
FIG. 12 is a view similar to FIGS. 9 and 10 showing the slide lock plate being moved toward the open unlocked position.
Figure 13:
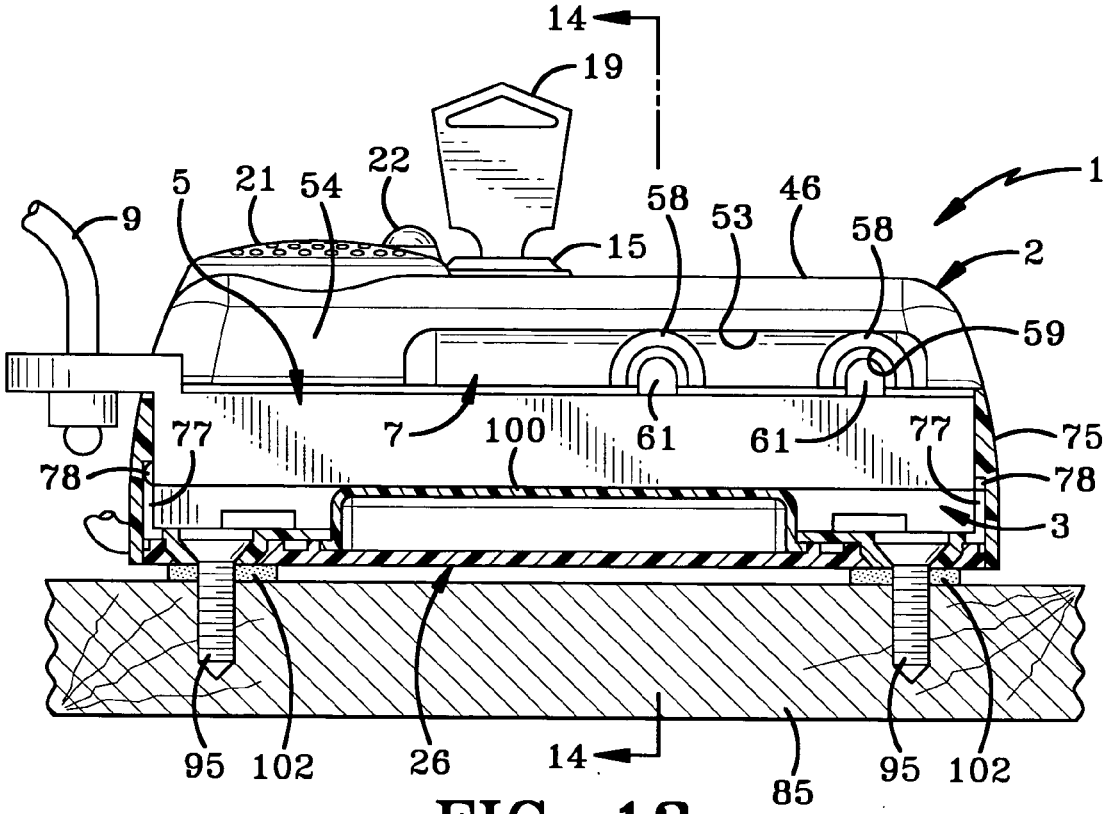
FIG. 13 is a view similar to FIG. 3 with a magnetic security key in locked position in the docking station.
Figure 14:
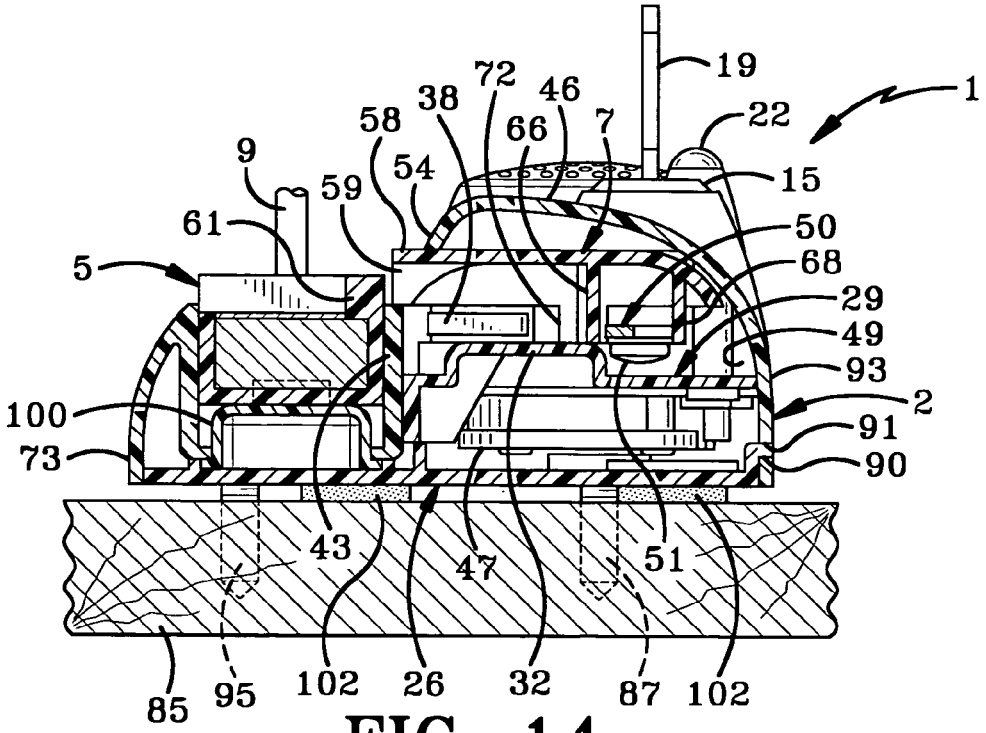
FIG. 14 is a sectional view taken on Line 14—14, FIG. 13.

Alarm system mounting plate 29 forms an upper compartment 49 in housing 2 (FIGS. 4 and 8) between alarm mounting plate 29 and top wall 46 of upper housing portion 25 in which is located a camming lever 50, which is connected to the lower end of tumbler mechanism 15 by a fastener 51. The body of tumbler 15 extends into upper compartment 49 as shown in FIG. 8 and is securely connected to lever 50. Slide plate 7 is located in compartment 49 and extends through an open slot 53 formed in a front wall 54 of upper housing portion 25. Slide plate 7 has a generally flat-shape with a curved front portion 57 in which is formed a pair of semi-circular raised portions 58 forming semi-circular openings 59 to provide clearance for slide plate 7 when it moves over a pair of positioning tabs 61 formed on certain types of security keys 5 as shown in FIGS. 2, 12 and 13.

The underside surface of lock plate 7, as shown in FIGS. 6. and 9–11 includes an outer peripheral rib 63, which extends generally around the perimeter of slide plate 7 and is connected to a plurality of linearly extending ribs 65, which provides strength and rigidity to plate 7. A slightly curved rib 66 extends upwardly from a rear portion of slide plate 7 above the height of ribs 63 and 64, and is connected at one end to peripheral rib 63 and at the other end with peripheral rib 66 at junction 65. A short linearly extending rib 68 extends outwardly from a portion of curved rib 66 and preferably has the same height as rib 66 and forms a partially enclosed area 69 therewith. Camming lever 50 includes a curved distal end 71 which is located within enclosed area 69, as shown in FIG. 6 when slide plate 7 is in the open unlocked position as shown therein.

Front key-receiving compartment 3 is formed by a bottom wall 76, a front wall 73, rear wall 43 discussed above, and spaced parallel end walls 75. A pair of small openings 77 (FIG. 2), preferably are formed at the junction of bottom wall 76 and end walls 75 for receiving small tabs 78. Openings 77 align with and are located at the bottom of small notches 79 formed in end walls 75. Small tabs 78 are formed on the ends of certain keys 5, as shown in FIG. 10, to assist in securing key 5 in compartment 3 by their engagement in openings 77 and notches 79.

Rib 64 and peripheral rib area 63A (FIG. 6) slidably engage the top surface of raised platform portion 33 and ribs 66 and 68 slidably engage lower platform portion 32 as slide plate 7 moves between open and closed positions. The top surface of slide plate 7 also moves along a plurality of raised ribs 80 which are formed on the internal surface of housing portion top wall 46 and extend into upper compartment 49 (FIG. 10) to assist in maintaining slide plate 7 in position within compartment 49 for sliding movement over compartment top opening 4.

Figure 7:
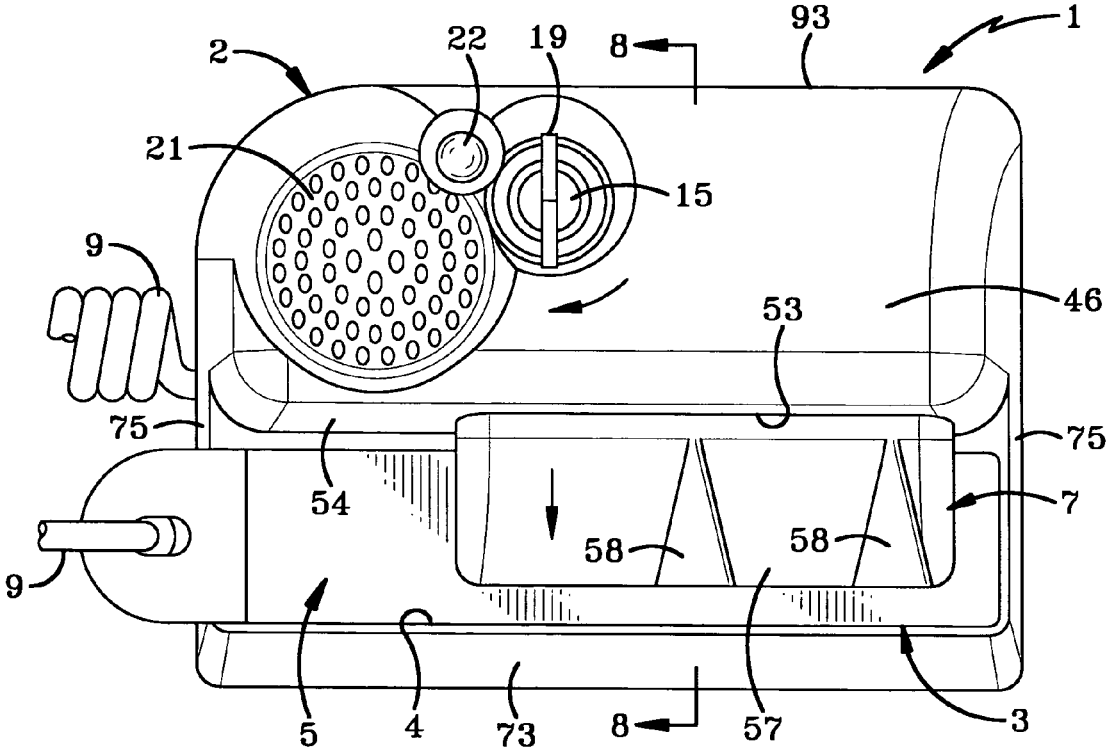
FIG. 7 is a top plan view of the docking station with the slide lock plate being in the locked position securing a key in the storage compartment.
Figure 9:
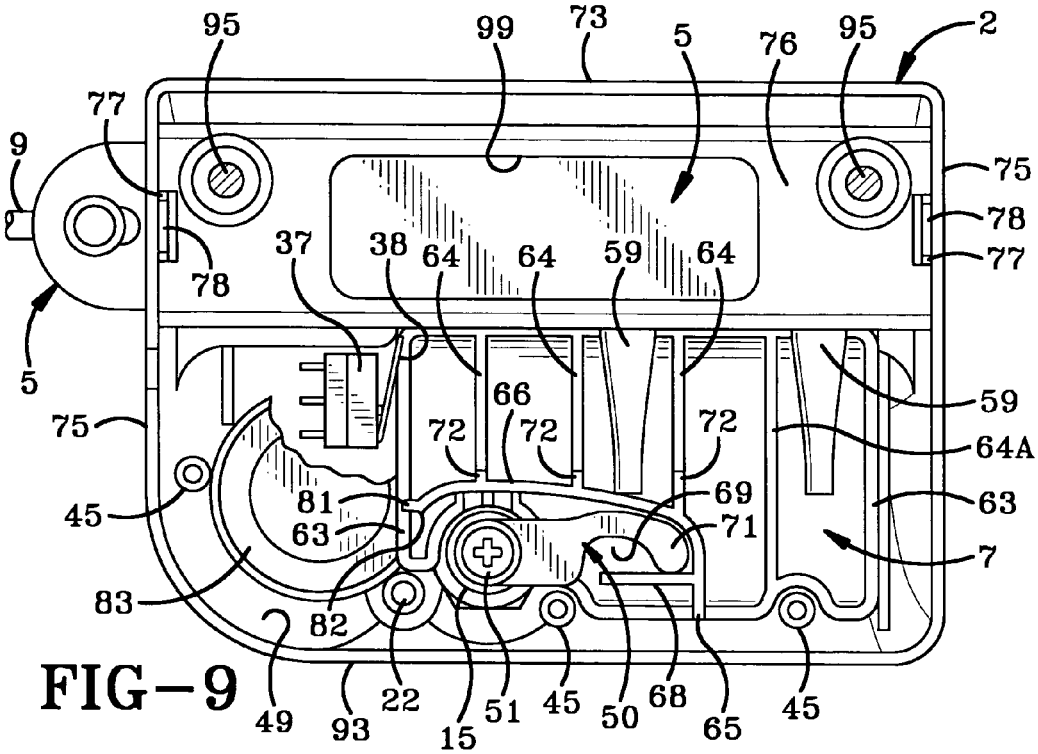
FIG. 9 is a bottom plan view of the docking station with the bottom cover plate being removed and with portions of the alarm support plate broken away showing the position of the camming lever when the slide lock plate is in the open position.

The operation of docking station 1 is as follows. Key 5 is inserted easily into compartment 3 through open top 4 when slide plate 7 is in a retracted unlocked position as shown in FIG. 2. Tabs 78, at the ends of key 5 are inserted or snap-fitted into notches 79 and openings 78 to help secure key 5 in the compartment. However, these tabs only facilitate the placement of the key in the compartment and are not required since the key is securely locked therein by slide plate 7 when in the locked position, as shown in FIG. 7. When in the open position of FIG. 2 for receiving key 5 in compartment 3, slide plate 7 will be in a rearward position as shown in FIG. 9 with distal end 71 of lever 50 being located within enclosed area 69 between curved rib 66 and linear rib 68. To move plate 7 to the locked position, key 19 is inserted into key slot 17 of tumbler 15 which is rotated in a clockwise direction as shown in FIG. 2, to a second tumbler position, which will cause lever 50 to move in a counterclockwise direction of FIGS. 6 and 9 and slidably engage rib 66 pushing slide plate 7 forwardly until it reaches the closed locked position as shown in FIG. 10. The rounded curved configuration of distal end 50 will provide for a smooth sliding engagement along curved rib 69 moving slide plate 7 in the direction of Arrow A (FIG. 10), until it reaches a full locked position as shown in FIG. 7 where it sufficiently covers compartment opening 4 preventing the removal of key 5 therefrom. The perpendicular abutting engagement of distal end 71 with curved rib 69 as shown in FIG. 10, and the locked position of tumbler mechanism 15 in this second position will prevent the rearward or unlocking movement of slide plate 7 until tumbler mechanism 15 is rotated in a clockwise direction in FIG. 10 toward its first position of FIG. 9 moving lever 50 in the same direction as discussed further below. A plurality of raised ribs 72 (FIG. 10) will abut rear wall 43 upon slide plate 7 reaching its forward locking position to prevent further movement and possible removal of the slide plate from housing 2. Key 19 can then be removed from tumbler 15 when in the second position preventing unauthorized removal of security key 5 from compartment 3.

In accordance with another feature of the invention, any further unlawful manipulation of the sense circuit formed by conductors 11, such as cutting one or more of the conductors 11 or pulling them from their securement within housing 2 or dislocating them from the circuit board, will cause an audible alarm as shown at 83 (FIGS. 9–12), located adjacent external grill 21, to sound, alerting personnel that an attempt is being made to unlawfully remove key 5 from attachment cord 9 regardless of the position of key 5 with respect to the docking station.

Should audible alarm 83 be activated by the integrity of the sense loop being compromised or even by a malfunction or false alarm, a store personnel will turn key 19 in a further clockwise direction (FIG. 2) which will move tumbler mechanism 15 to a third position moving lever 50 from the position of FIG. 10 to that of FIG. 11. Distal end 71 will click past a small nub 82 formed adjacent an end 81 of rib 66 and move switch lever 38 inwardly to open the alarm circuit to inactivate and silence alarm 83. Lever 50 will remain in this position until the cause of the alarm actuation has been determined, after which key 19 is rotated moving lever 50 to the position of FIGS. 9–11 to rearm the alarm circuit.

LED 23 is always on to advise the store personnel and a potential thief that the docking system alarm is armed and active, irrespective of the position of slide lock plate 7, further reducing the unlawful tampering with docking station 1.

In order to move slide plate 7 from the locked position of FIGS. 7 and 10 to the unlocked position of FIGS. 2 and 9, tumbler mechanism 15 is rotated in a clockwise direction (FIG. 10) by the manual use of key 19, which will move distal end 71 into engagement with linear rib 68, as shown in FIG. 11. This engagement will slide locking plate 7 in the direction of Arrow A (FIG. 12) to the full unlocked position of FIGS. 6 and 9 enabling key 5 to be easily removed from compartment 3.

Thus, a clerk or authorized supervisor, upon leaving a checkout counter in an unsupervised manner, will merely insert security key 5 in compartment 3 and by the use of key 19, move slide plate 7 to the locked position and then after removing key 19 will retain security key 5 secured within compartment 3. The alarm system is always activated preventing theft of the security key by a thief or unscrupulous employee. The clerk or authorized personnel upon return to the checkout counter easily opens the docking station, permitting the removal of key 5 therefrom for use in disarming and opening secured packages before leaving the store premises.

It is readily understood that other key configurations than the elongated type key 5 containing magnets could be secured within storage compartment 3 so long as slide plate 7 is configured and sized to sufficiently cover top opening 4 thereof to prevent removal of the key once placed therein. Thus, compartment 4 could be considerably smaller and/or slide plate larger to more fully cover the access opening, preventing removal of even a smaller security key from within compartment 3.

Docking station 1 preferably is secured to a supporting structure, such as a countertop 85 (FIG. 8), by a pair of fastening screws 87 which extend through holes 88 formed in bottom wall plate 26 (FIG. 5). Bottom wall plate 26 includes a plurality of angled tabs 90 which extend through complimentary shaped slots 91 formed at the lower end of rear wall 93 of upper housing portion 25. Upper housing portion 25 is then moved about tabs 90 to a closed position over bottom wall plate 26, and two additional fasteners or screws 95 are inserted through aligned holes 96 and 97 formed in bottom wall 76 of compartment 3 and bottom wall plate 26 respectively (FIGS. 2, 3, and 5). A plurality of resilient pads 102 (FIGS. 8, 12 and 13) are attached to the bottom surface of bottom wall plate 26 to provide a slightly resilient mounting of docking station 1 on surface 85.

Figure 4:
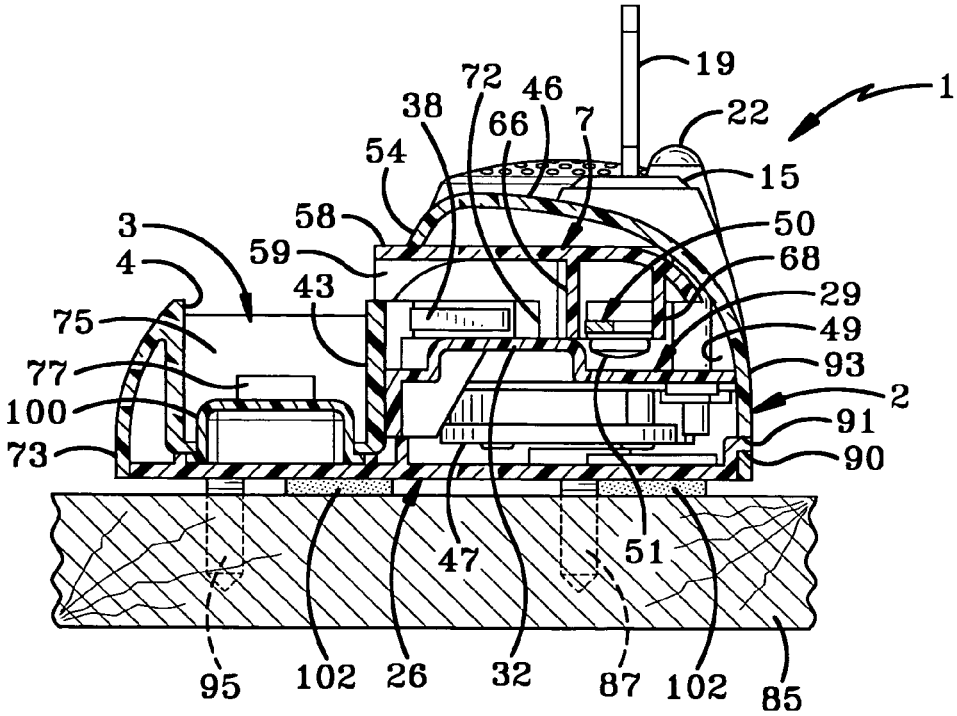
FIG. 4 is a sectional view taken on Line 4—4, FIG. 2.

Bottom wall 76 of compartment 3 preferably is formed with a rectangular-shaped opening 99 (FIG. 5) in which is received a raised insert 100 FIGS. 2 and 4, which provides a platform on which key 5 rests when placed within compartment 3. This enables the spacing from the bottom of slide plate 7 to closely match the thickness of the particular key 5 placed in compartment 3. Thus, if a different thickness key is intended for storage in compartment 3, the height of insert 100 could vary to provide just enough space between slide plate 7 and insert 100 to match the thickness of key 5. This provides for a snug fit of the key in the compartment and can be configured to match certain contours of the key if necessary.

It is readily understood that the alarm sensing loop in cord 9 can be optical instead of using electrical conductors therein without affecting the concept of the invention.

Accordingly, docking station 1 provides for a relatively simple and inexpensive device formed of rugged plastic material, which can be securely mounted at a checkout counter and easily operated to secure a security key in a storage compartment in a locked position when the checkout counter is left unattended or unsupervised, preventing unauthorized removal and theft of the security key, which could be used later at a store for facilitating the theft of merchandise.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A docking station for storing a security key in a secure condition, said station comprising:

a housing formed with a compartment for storing the security key therein, said compartment having an opening for placement and removal of the key into and from said compartment;

a slide member selectively movable across at least a portion of the compartment opening between locked and unlocked positions to prevent removal of the key from the compartment when in the locked position;

a key actuated cam operatively engageable with the slide member for moving said slide member between locked and unlocked positions;

a cord connected to and extending between the housing and the security key to attach the security key to the housing, said cord containing electrical conductors forming an alarm sensing loop; and an alarm system contained within the housing and operatively connected to the cord for monitoring the integrity of the sensing loop and actuating an audible alarm if the integrity of the sensing loop is compromised.

2. The docking station defined in claim 1 including a key operated tumbler operatively connected to the cam and moveable between first and second positions for moving the slide member between unlocked and locked positions, respectively.

3. The docking station defined in claim 2 wherein the key operated tumbler is moveable to a third position for inactivating the audible alarm.

4. The docking station defined in claim 1 wherein the alarm system includes a battery contained within the housing for supplying electric power for operating the alarm system.

5. The docking station defined in claim 1 wherein the alarm system includes a visual signal indicating that the alarm system is operational.

6. The docking station defined in claim 5 wherein the visual signal is a blinking LED.

7. The docking station defined in claim 1 wherein the alarm system includes a switch cooperatively engageable with the key actuated cam to actuate the switch to inactivate the audible alarm.

8. The docking station defined in claim 1 including fasteners for securing the housing to a support structure.

9. The docking station defined in claim 1 wherein the slide member has a first upstanding rib; and in which the cam has a distal end which slidably engages said first upstanding rib and moves between first and second positions to move said slide member from the unlocked position to the locked position, respectively.

10. The docking station defined in claim 9 wherein the first upstanding rib is formed with a projecting nub; and in which the distal end of the cam moves past the nub to a third position to inactivate the audible alarm.

11. The docking station defined in claim 9 wherein the slide member has a second upstanding rib; and in which the distal end of the cam engages said second rib to move the slide member from the locked position to the unlocked position.

12. The docking station defined in claim 9 wherein the distal end of the cam is curved; and in which the first rib is curved to provide for smooth sliding engagement therebetween.

13. The docking station defined in claim 11 wherein a key operated tumbler is operatively connected to the cam; in which the second rib forms a partially enclosed area with the first rib; and in which the distal end of the cam is trapped in said area to prevent movement of the slide member toward locked position until the distal end of the cam is moved by the key operated tumbler.

14. The docking station defined in claim 1 wherein the housing compartment is formed by a bottom wall, spaced end walls and spaced front and back walls; and in which notches are formed in the end walls for receiving tabs formed on the security key to assist in retaining the key in the compartment.

15. The docking station defined in claim 1 wherein the housing has a bottom wall plate adapted to be secured to a support structure by fasteners and a separate upper housing member connected at one end to the bottom wall plate and adapted to be secured to the support structure by other fasteners.

16. The locking station defined in claim 15 wherein the upper housing member is connected to the bottom wall plate by a plurality of tabs formed on one of the bottom wall plate and housing member which is engageable in a plurality of openings formed in the other of said bottom wall plate and housing member.

17. The locking station defined in claim 15 wherein the key storage compartment has a bottom wall formed with an opening; and in which an insert is trapped between the bottom wall of the compartment and the bottom wall plate and extends into the compartment to provide a pedestal for supporting the security key thereon.

18. In combination, a security key and a docking station for storing the security key in a secure condition, said docking station comprising:

a housing formed with a compartment for storing the security key therein, said compartment having an opening for placement and removal of the key into and from said compartment;

a lock member selectively movable across at least a portion of the compartment opening between locked and unlocked positions to prevent removal of the key from the compartment when in the locked position;

a key actuated mechanism operatively engageable with the lock member for moving said lock member between the locked and unlocked positions;

a cord connected to and extending between the housing and the security key attaching the security key to the housing, said cord containing at least one conductor forming an alarm sensing loop; and an alarm system contained within the housing and operatively connected to the cord for monitoring the integrity of the sensing loop and actuating an audible alarm if the integrity of the sensing loop is compromised.

19. The docking station defined in claim 1 wherein the key operated mechanism includes a three position key operated tumbler operatively connected to a camming lever for moving the lock member between the locked and unlocked positions, and to inactivate the audible alarm when in a third position.

20. The docking station defined in claim 18 wherein the alarm system includes a visual signal which indicates when the alarm system is activated.

* * * * *